US007913878B1

(12) United States Patent
Baron et al.

(10) Patent No.: US 7,913,878 B1
(45) Date of Patent: Mar. 29, 2011

(54) TERMINAL ORIFICE PROCESSOR

(75) Inventors: Richard D. Baron, Zephyrhills, FL (US); Steven A. Garbee, Brandon, FL (US)

(73) Assignee: Nestec, S. A. (CH)

( * ) Notice: Subject to any disclaimer, the term of this patent is extended or adjusted under 35 U.S.C. 154(b) by 803 days.

(21) Appl. No.: 11/511,549

(22) Filed: Aug. 28, 2006

Related U.S. Application Data

(60) Provisional application No. 60/712,207, filed on Aug. 29, 2005.

(51) Int. Cl.
*B67D 7/74* (2010.01)

(52) U.S. Cl. ..... 222/129.1; 222/145.5

(58) Field of Classification Search .... 222/129.1–129.4, 222/145.1–145.6, 640
See application file for complete search history.

(56) References Cited

U.S. PATENT DOCUMENTS

| | | | | |
|---|---|---|---|---|
| D73,990 | S | | 11/1927 | Young |
| D133,160 | S | | 7/1942 | Evans |
| D141,362 | S | | 5/1945 | Elkins |
| D156,089 | S | | 11/1949 | Fuerst |
| D156,279 | S | | 11/1949 | Rasmusson |
| 2,554,570 | A | | 5/1951 | Harvey |
| D167,991 | S | | 10/1952 | Mack |
| 2,685,985 | A | | 8/1954 | Howell |
| 2,702,147 | A | | 2/1955 | Brown |
| 2,716,507 | A | | 8/1955 | Graves |
| 2,737,880 | A | | 3/1956 | Johnson |
| D178,846 | S | | 9/1956 | Norris |
| 2,772,817 | A | | 12/1956 | Jauch |
| 2,927,522 | A | | 3/1960 | Rockwood et al. |
| D192,619 | S | | 4/1962 | Mojonnier |
| D192,621 | S | | 4/1962 | Mojonnier |
| D193,217 | S | | 6/1962 | Cassell |
| D193,741 | S | | 10/1962 | Westhoven et al. |
| D194,564 | S | | 2/1963 | Mojonnier |
| D196,939 | S | | 11/1963 | Cigognetti |
| D197,993 | S | | 4/1964 | Mojonnier |
| D197,994 | S | | 4/1964 | Mojonnier |
| D198,475 | S | | 6/1964 | Mojonnier |
| 3,140,861 | A | * | 7/1964 | Krup ..... 366/156.1 |
| 3,176,879 | A | | 4/1965 | Mojonnier |
| D203,074 | S | | 11/1965 | Adell |
| D206,519 | S | | 12/1966 | Wolfe |
| 3,338,459 | A | | 8/1967 | Smith |
| D209,126 | S | | 10/1967 | Martin |
| D209,342 | S | | 11/1967 | Thompson et al. |
| D211,316 | S | | 6/1968 | Kusterman et al. |
| D212,258 | S | | 9/1968 | Cornelius et al. |
| D213,040 | S | | 12/1968 | Schaper et al. |
| 3,460,717 | A | * | 8/1969 | Thomas ..... 222/129.1 |
| D218,019 | S | | 7/1970 | Lattrave |
| D218,281 | S | | 8/1970 | Diener |
| 3,568,887 | A | * | 3/1971 | Jacobs et al. ..... 222/640 |
| D221,202 | S | | 7/1971 | Lorang |

(Continued)

*Primary Examiner* — Lien T Ngo
(74) *Attorney, Agent, or Firm* — Frijou, Rust & Pyle, P.A.

(57) ABSTRACT

A terminal orifice processor is disclosed for processing a first and a second liquid emanating from a discharging aperture. The terminal orifice processor comprises a housing having a housing input and a housing output. A connector locates the housing input of the housing below the discharging aperture. A processing channel is interposed between the housing input and the housing output for altering the direction of the first and a second liquid emanating from a discharging aperture for processing the first and second liquids prior to exiting from the housing output. The terminal orifice processor is suitable for mixing and aerating a concentrate and a diluent from a beverage-dispensing machine.

7 Claims, 13 Drawing Sheets

U.S. PATENT DOCUMENTS

D223,325 S 4/1972 Mox
D223,334 S 4/1972 Hayes et al.
D224,511 S 8/1972 Koenigsberg
D226,703 S 4/1973 Broadhead
D227,002 S 5/1973 Broadhead
3,740,231 A 6/1973 Drwal et al.
3,756,398 A 9/1973 Green et al.
3,771,432 A 11/1973 Karlen
3,793,935 A 2/1974 Martin
3,828,985 A 8/1974 Schindler
D233,081 S 10/1974 Koch et al.
D233,271 S 10/1974 Holcomb
D235,388 S 6/1975 Taylor
D236,807 S 9/1975 Schmidt
3,940,002 A 2/1976 Schiemann
3,948,105 A 4/1976 Johnson, Jr.
D241,915 S 10/1976 Campbell et al.
D242,770 S 12/1976 Mitchell
4,064,795 A 12/1977 Ackerman
D247,770 S 4/1978 Sagona
4,088,298 A 5/1978 Brown
4,155,487 A 5/1979 Blake
4,185,927 A * 1/1980 Uttech ..... 366/131
D254,184 S 2/1980 Martin et al.
4,194,651 A * 3/1980 Martin et al. ..... 222/108
D255,093 S 5/1980 Hartung et al.
4,228,758 A 10/1980 Dornau et al.
4,252,073 A 2/1981 Hartung et al.
4,324,494 A * 4/1982 Pryor et al. ..... 366/156.1
4,334,640 A 6/1982 van Overbruggen et al.
D265,653 S 8/1982 Arzberger et al.
4,393,982 A 7/1983 Kuckens
D269,948 S 8/1983 Janssen
D272,976 S 3/1984 LaLumiere
D274,029 S 5/1984 Daugherty
4,579,260 A 4/1986 Young et al.
D288,531 S 3/1987 Terasevich et al.
4,646,945 A 3/1987 Steinen et al.
4,651,862 A * 3/1987 Greenfield, Jr. ..... 194/344
D289,612 S 5/1987 Carlson
D289,976 S 5/1987 Humpries
D294,117 S 2/1988 Rogler et al.
D294,118 S 2/1988 Papa
D294,463 S 3/1988 Lang
D294,678 S 3/1988 Papa
D295,381 S 4/1988 Papa
D296,668 S 7/1988 Stavish
4,776,495 A 10/1988 Vignot
4,779,761 A 10/1988 Rudick et al.
4,816,273 A 3/1989 Smith et al.
D302,522 S 8/1989 Charbonneau et al.
D303,083 S 8/1989 Powell et al.
4,901,878 A 2/1990 Humphries
D308,825 S 6/1990 Hoyt
4,952,068 A 8/1990 Flint
4,953,754 A 9/1990 Credle, Jr.
D315,869 S 4/1991 Collette
D319,976 S 9/1991 Wortley et al.
D320,157 S 9/1991 Nobile et al.
D320,931 S 10/1991 Siegel
D321,320 S 11/1991 Halm
D322,383 S 12/1991 Jones
5,114,047 A 5/1992 Baron et al.
5,123,575 A 6/1992 Li
5,186,363 A * 2/1993 Haynes ..... 222/145.5
5,498,078 A * 3/1996 Keller ..... 366/339
5,549,222 A * 8/1996 Schroeder ..... 222/129.1
5,797,519 A * 8/1998 Schroeder et al. ..... 222/129.1
5,918,768 A * 7/1999 Ford ..... 222/113
6,149,035 A * 11/2000 Gorski et al. ..... 222/129.4
6,394,312 B1 * 5/2002 Endou ..... 222/129.1

* cited by examiner

PRIOR ART

TERMINAL ORIFICE PROCESSOR

CROSS-REFERENCE TO RELATED APPLICATIONS

This application claims benefit of U.S. Patent Provisional application Ser. No. 60/712,207 filed Aug. 29, 2005. All subject matter set forth in provisional application Ser. No. 60/712,207 is hereby incorporated by reference into the present application as if fully set forth herein.

BACKGROUND OF THE INVENTION

1. Field of the Invention

The invention relates to liquid dispensing and more particularly to an improved terminal orifice processor for mixing and aerating a first and a second liquid.

2. Description of the Related Art

Various types of liquid dispensing devices have been provided by the prior art for mixing a first liquid and a second liquid. One particular type of liquid dispensing device relates to the mixing of a concentrate with a diluent. In this type of liquid dispensing device, a liquid concentrate is mixed with a larger volume of liquid diluent for producing a final liquid mixture. Liquid dispensing devices for mixing a liquid concentrate with a liquid diluent have found widespread use for a number of applications including the mixing and dispensing a consumable liquids. When a liquid dispensing device was used for dispensing consumable liquid, the liquid dispensing device must be constructed in a manner to be periodically cleaned in order to maintain the wholesomeness of the consumable liquid.

One significant advancement in the dispensing of consumable liquids from a concentrate is the invention set forth in our U.S. Pat. No. 5,114,047. U.S. Pat. No. 5,114,047 discloses a pump and mixing device for pumping a liquid from a container and mixing with a diluent. The pump and mixing device comprises a body member having an input body portion and an output body portion with a flexible wall defining a pumping chamber between the input body portion and the output body portion. The input body portion has an input aperture for enabling the liquid to flow from the container into the input body portion. The output body portion has an output aperture communicating with the flowing diluent. An input one-way valve is disposed in the input aperture for permitting the flow of liquid only from the container to the pumping chamber whereas an output one-way valve is disposed in the output aperture for permitting the flow of liquid only from the pumping chamber. A motive device reciprocates the output body portion relative to the input body portion between a first and a second position for causing liquid to flow from the container through the input one-way valve into the pumping chamber when the output body portion is moved into the first position and for causing liquid to flow from the pumping chamber through the output one-way valve to mix with the diluent when the output body portion is moved into the second position.

U.S. Pat. No. 5,114,047 was reduced to practice in a beverage vending machine for pumping a liquid concentrate from a container and mixing the concentrate with a diluent. The beverage vending machine mixed various liquid concentrates with water diluent to provide a consumable liquid. The aforesaid beverage vending machine had the advantage of utilizing a disposable pump and mixing device connected to a container storing the liquid concentrate. After the depletion of the liquid concentrate, the pump and mixing device as well as the container was discarded thus eliminating the need for periodic cleaning. The beverage vending machine manufactured under U.S. Pat. No. 5,114,047 found rapid substantial commercial success.

Although the beverage vending machine manufactured under U.S. Pat. No. 5,114,047 remains a successful commercial product to the present day, the beverage vending machine required an improvement in three areas. Firstly, some products were not entirely mixed by the pump and mixing device upon discharge at the terminal orifice of the beverage vending machine. In general this was not a significant problem since the concentrate and the diluent was further mixed upon falling into a drinking container. Secondly, the pump and mixing device did not adequately aerate the mixture of the concentrate and the diluent. Thirdly, the pumping speed of the pump and mixing device was slow compared to some conventional beverage vending machines.

Therefore is an object of this invention is to provide a terminal orifice processor for processing a first and a second liquid emanating from a discharging aperture that improves upon our prior inventions.

Another object of this invention is to provide a terminal orifice processor for processing a first and a second liquid that mixes the first and second liquids.

Another object of this invention is to provide a terminal orifice processor for processing a first and a second liquid to aerate the first and second liquids.

Another object of this invention is to provide a terminal orifice processor for processing a first and a second liquid that enables first and second liquids to be pumped at a higher speed.

Another object of this invention is to provide a terminal orifice processor for processing a first and a second liquid to be retrofitted into existing beverage vending machines.

Another object of this invention is to provide a terminal orifice processor for processing a first and a second liquid that is inexpensive to add to beverage vending machines.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved terminal orifice processor for processing a first and a second liquid emanating from a discharging aperture. The terminal orifice processor comprises a housing having a housing input and a housing output. A connector locates the housing input of the housing below the discharging aperture. A processing channel is interposed between the housing input and the housing output for altering the direction of the first and a second liquid emanating from a discharging aperture for processing the first and second liquids prior to exiting from the housing output.

In one specific embodiment of the invention, the first and second liquid emanating from the discharging aperture are a concentrate and a diluent with the processing channel between the housing input and the housing output mixing and aerating the concentrate and a diluent.

In one embodiment of the invention, the housing is formed from a generally stiff polymeric material the housing insert is formed from a generally flexible polymeric material.

The housing comprises a front wall, a rear wall and a first and a second sidewall. The rear wall includes an angled rear wall portion forming an angle relative to the front wall of the housing. The housing is secured relative to the discharging aperture for enabling the first and second liquid emanating from the discharging aperture to impact the angled rear wall portion of the rear wall.

Preferably, the housing input and the housing output are integral with the housing as a one-piece unit. The housing input comprises a housing input orifice and the housing output comprising a housing output orifice with the input orifice being larger than the output orifice. In one specific example, the housing input orifice is an elongated orifice whereas the housing output orifice comprising a substantially cylindrical nozzle defining the housing output orifice.

In another embodiment of the invention, the improved terminal orifice processor includes a housing insert. The housing insert comprises a generally transverse wall defining an upper chamber and a lower chamber with a transverse wall aperture communicating the upper chamber with the lower chamber. The transverse wall aperture is offset axially from the housing output.

A plurality of depending fingers extends from the transverse wall in proximity to the housing output. The housing includes an obstruction located in the housing output of the housing for cooperating with the plurality of depending fingers for creating the tortuous path between the housing input and the housing output.

In a more specific embodiment of the invention, the first and second liquid emanating from a discharging aperture is a consumable concentrate and a diluent. The tortuous path between the housing input and the housing output mixes and aerates the consumable concentrate with the diluent to provide an enhanced taste to the consumable product.

The invention is also incorporated into a dispenser device for dispensing a liquid from a discharge aperture. The dispenser device is contained within a cabinet having a hinged front door for enabling access to the dispenser device. The improvement comprises a terminal orifice processor having an input orifice and a terminal orifice. A connector connects the terminal orifice processor to the hinged front door for locating the input orifice below the discharge aperture when the hinged front door is in a closed position. A processing channel is interposed between the input orifice and the terminal orifice for altering the direction of the first and a second liquid emanating from the discharging aperture for processing the first and second liquids prior to exiting from the terminal orifice.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
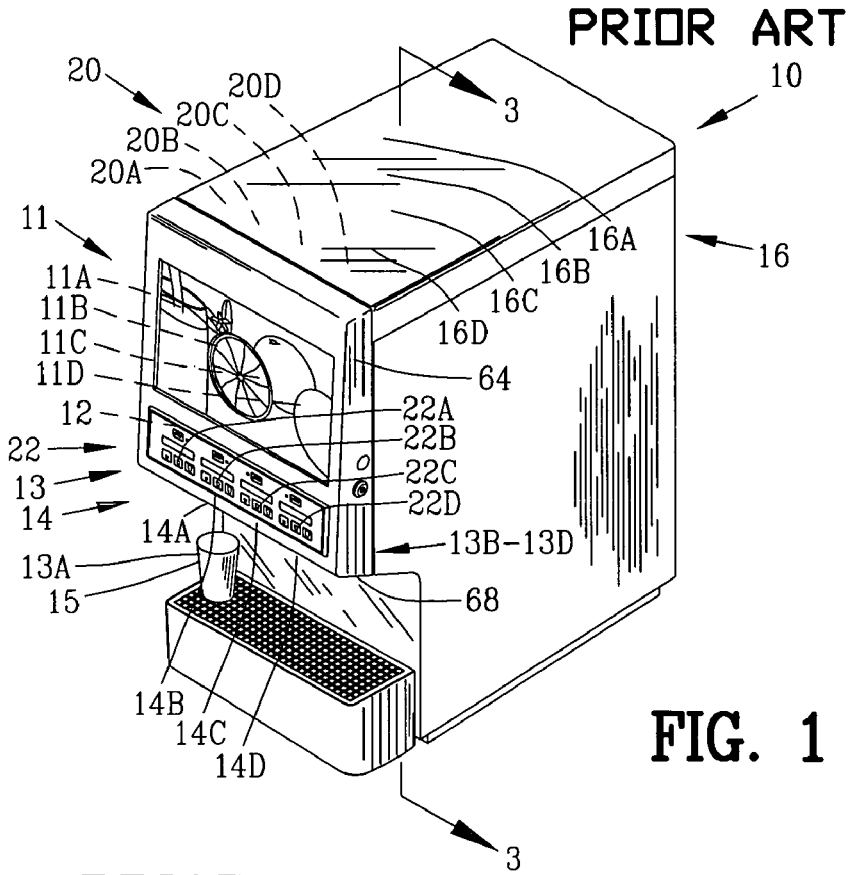
FIG. 1 is an isometric view of a dispenser system of the prior art.

FIG. 1 is an isometric view of a prior art dispenser device 10 for pumping a first liquid 11 and a second liquid 12. The dispenser device 10 mixes the first liquid 11 and the second liquid 12 to provide a mixed product 13 for discharge from a discharge aperture 14 into a vessel shown as a cup 15. In this example, the first liquid 11 is a first liquid concentrate 11 and the second liquid 12 is a second liquid diluent 12. Preferably, the second liquid diluent 12 is potable water.

The dispenser device 10 includes a pump and mixing device 20 controlled by an operator switch 22. Upon actuation of the operator switch 22, the pump and mixing device 20 pumps the first liquid concentrate 11 to mix with the second liquid diluent 12. The mixed first liquid concentrate 11 and the second liquid diluent 12 are discharged as the mixed product 13 from the discharge aperture 14 of the pump and mixing device 20.

In this specific example, the prior art dispenser device 10 includes four concentrate containers 16A-16D for storing four separate first liquid concentrates 11A-11D. The dispenser 10 includes four separate pump and mixing devices 20A-20D controlled by four separate switches 22A-22D. The pump and mixing devices 20A-20D pump the four separate first liquid concentrates 11A-11D to mix with the common second liquid diluent 12 to provide four separate mixed products 13A-13D. The four separate mixed products 13A-13D are discharged from four separate discharge apertures 14A-14D.

Figure 2:
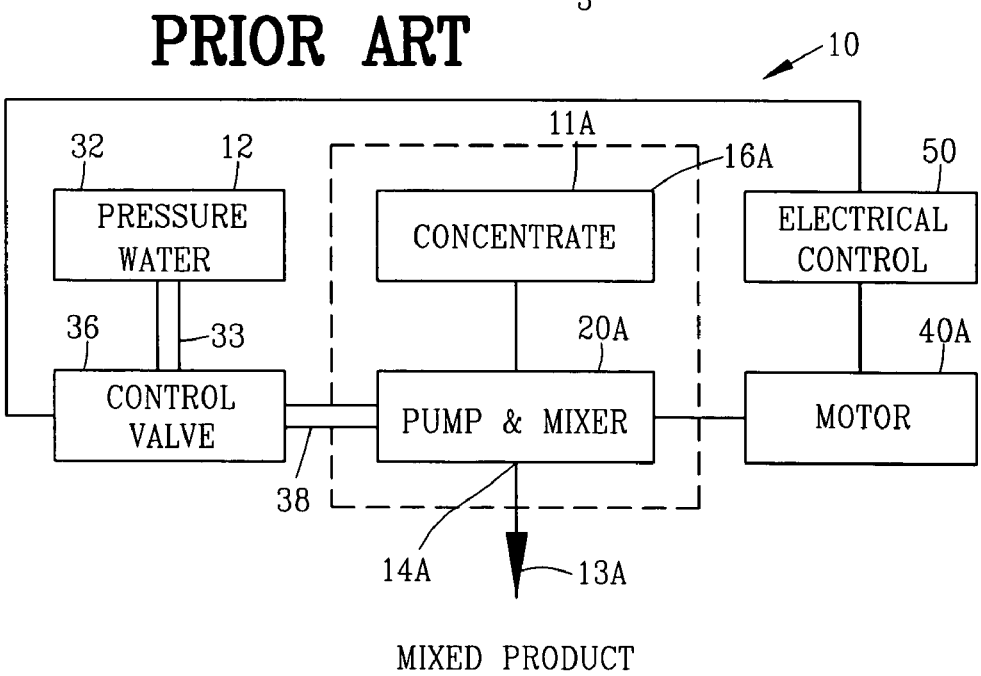
FIG. 2 is a block diagram of the dispenser system of FIG. 1.

FIG. 2 is a block diagram illustrating the mechanism of the dispenser device 10 of the pump and mixing device 20A of FIG. 1. The concentrate container 16A communicates with the pump and mixing device 20A for enabling the pump and mixing device 20A to pump the first liquid concentrate 11A. A pressurized source 32 of the second liquid diluent 12 is connected through a conduit 33 and a control valve 36 and conduit 38 to the pump and mixing device 20A. A motor 40A is connected to the pump and mixing device 20A for driving the pump and mixing device 20A.

An electrical control 50 is connected to operate the control valve 36 and the motor 40A. Upon actuation of the switch 22A, the second liquid diluent 12 flows through the water valve 36 and conduit 38 into the pump and mixing device 20A. Simultaneously, the pump and mixing device 20A pumps the first liquid concentrate 11A from the concentrate container 16A. The movement of the pump and mixing device 20A by the motor 40A pumps and mixes the first liquid concentrate 11A with the second liquid diluent 12 to discharge the mixed product 13A from the discharge aperture 14A.

Figure 3:
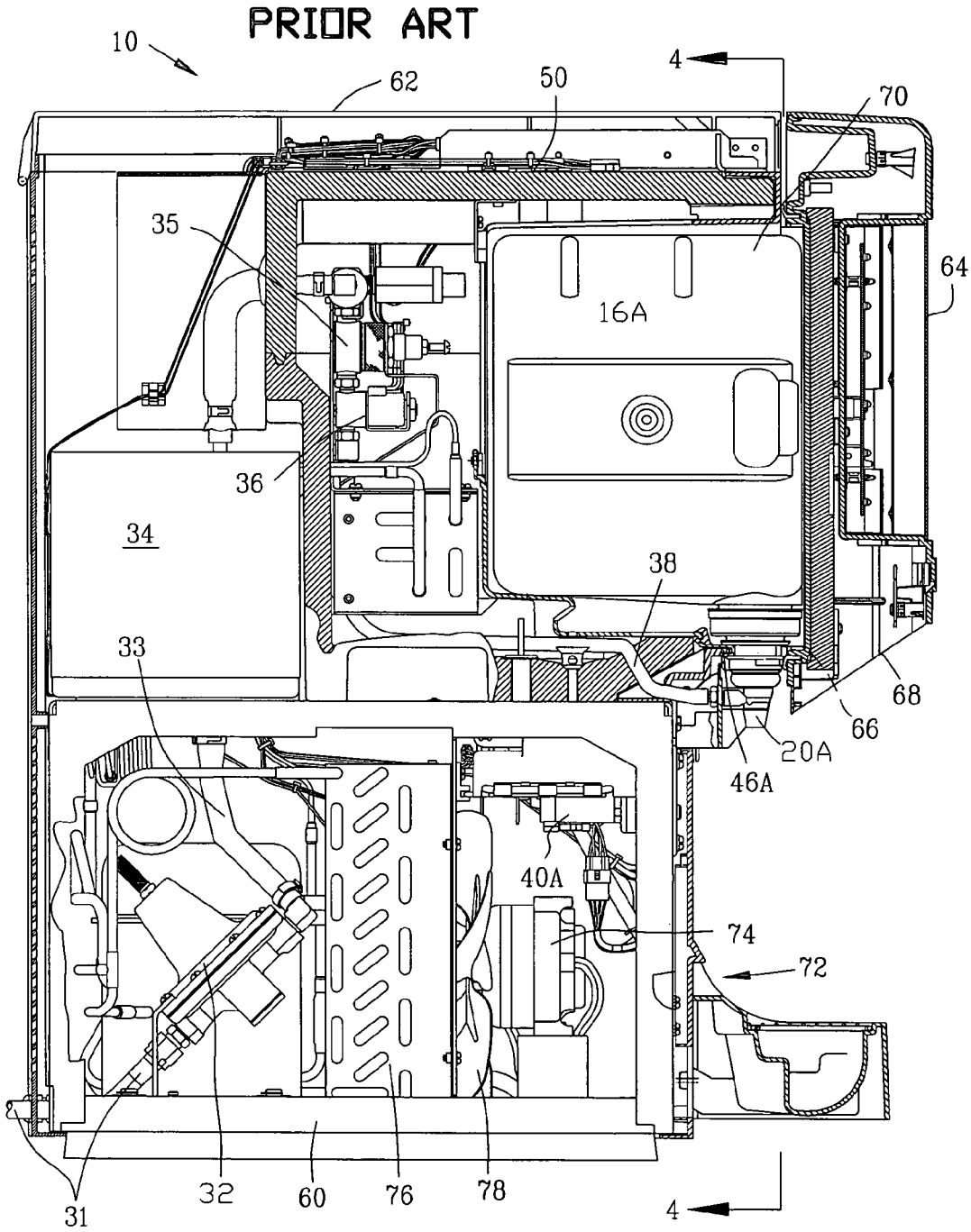
FIG. 3 is a sectional view along line 3-3 in FIG. 1.
Figure 4:
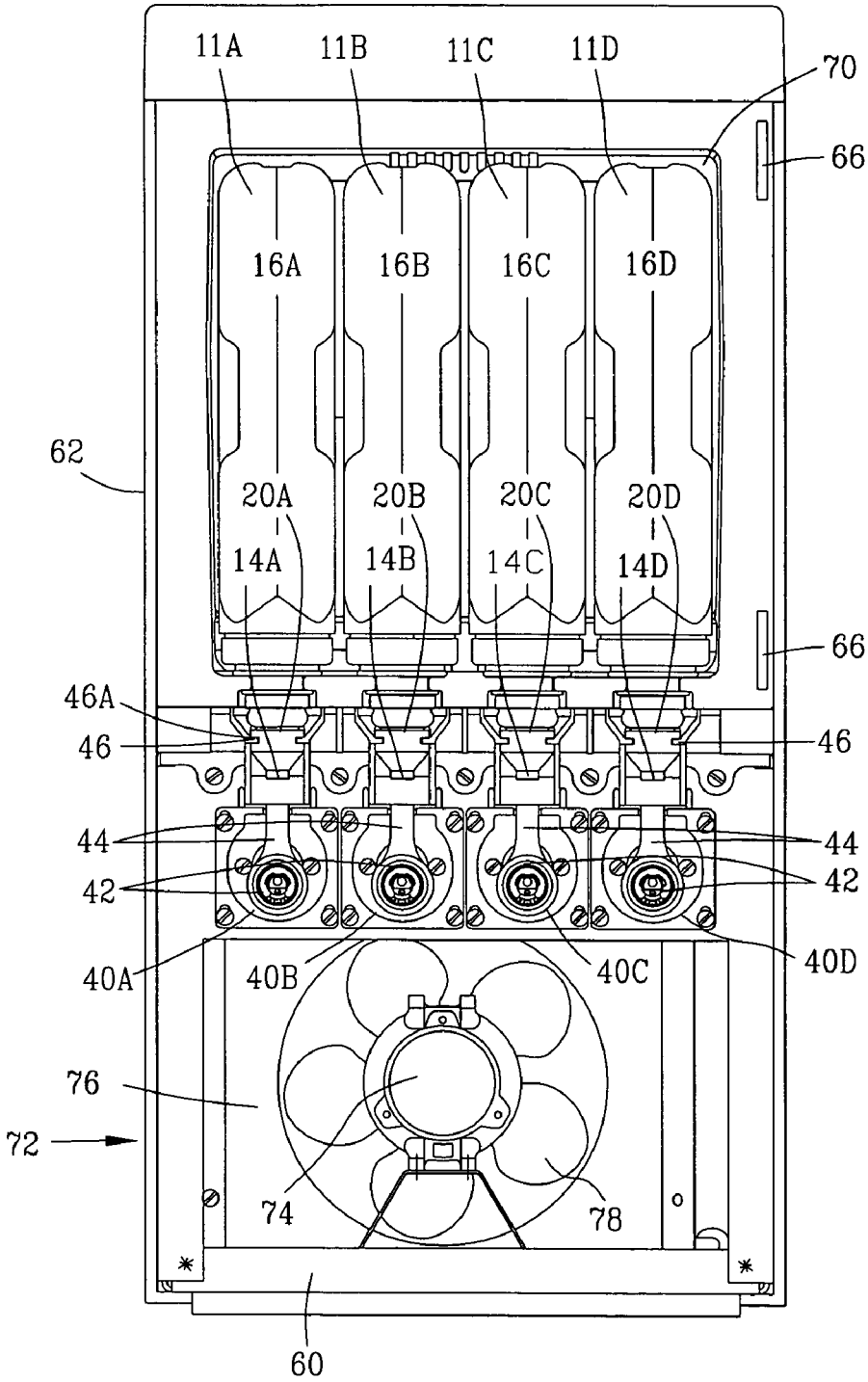
FIG. 4 is a sectional view along line 4-4 in FIG. 3.

FIGS. 3 and 4 are enlarged sectional views illustrating the interior of the dispenser device 10 shown in FIG. 1. The dispenser device 10 comprises a frame 60 for supporting various components of the dispenser device 10 including an outer covering shroud 62. A front door 64 is pivotably mounted to the frame 60 by hinges 66 for enabling an operator to access an interior of the dispenser device 10. The front door 64 includes a front door bottom 68.

The second liquid diluent 12 shown as water enters under conventional water pressure through an input conduit 31. The input conduit 31 is connected through a liquid pressure regulator 32 and a conduit 33 to a reservoir 34. A circulating pump 35 circulates the second liquid diluent 12 between the reservoir 34 and a refrigerated compartment 70 for maintaining the second liquid diluent 12 at a proper temperature for use. The control valve 36 controls the flow of the second liquid diluent 12 from the reservoir 34 to pumping and mixing devices 20A-20D through the flexible conduit 38.

A refrigeration unit 72 maintains the refrigerated compartment 70 at a reduced temperature. The refrigeration unit 72 includes a motor 74, a compressor 76 and a fan 78 connected in a conventional arrangement.

The pump and mixing devices 20A-20D are connected to the concentrate containers 16A-16D. The concentrate containers 16A-16D and the attached pump and mixing devices 20A-20D are loaded into and removed from the refrigerated compartment 70 through the front door 64. The refrigerated compartment 70 maintains the first liquid concentrates 11A-11D at a proper temperature for storage and use.

The pumping motors 40A-40D include eccentrics 42 for reciprocating driving arms 44. The reciprocating driving arms 44 are connected through coupling devices 46 to operate the pump and mixing devices 20A-20D.

When the concentrate containers 16A-16D and the attached pump and mixing devices 20A-20D are inserted within the refrigerated compartment 70 the attached pump and mixing devices 20A-20D are connected simultaneously to the conduit 38 and to the coupling devices 46.

The electrical control 50 operates the dispenser device 10 in response to the operator switches 22A, 22B, 22C and 22D. Upon activation of one of the operator switches 22A, 22B, 22C and 22D, the electrical control 50 energizes flow control valve 38 and a selected one of the pumping motors switches 22A, 22B, 22C and 22D for mixing the liquid diluent 12 with a selected one of the concentrates first liquid concentrates 11A-11D from the containers concentrate containers 16A-16D to produce the mixed product 13.

The prior art dispenser device 10 shown in FIGS. 1-4 is set forth in U.S. Pat. No. 5,114,047 entitled Pump and Mixing Device for Liquids issued to Richard D. Baron et al which is incorporated by reference into the present application as if fully set forth herein. Although the present invention is set forth with reference to the prior art dispenser device 10 shown in U.S. Pat. No. 5,114,047, it should be understood that the present invention may be used with other types, styles and configurations of dispenser devices.

Figure 5:
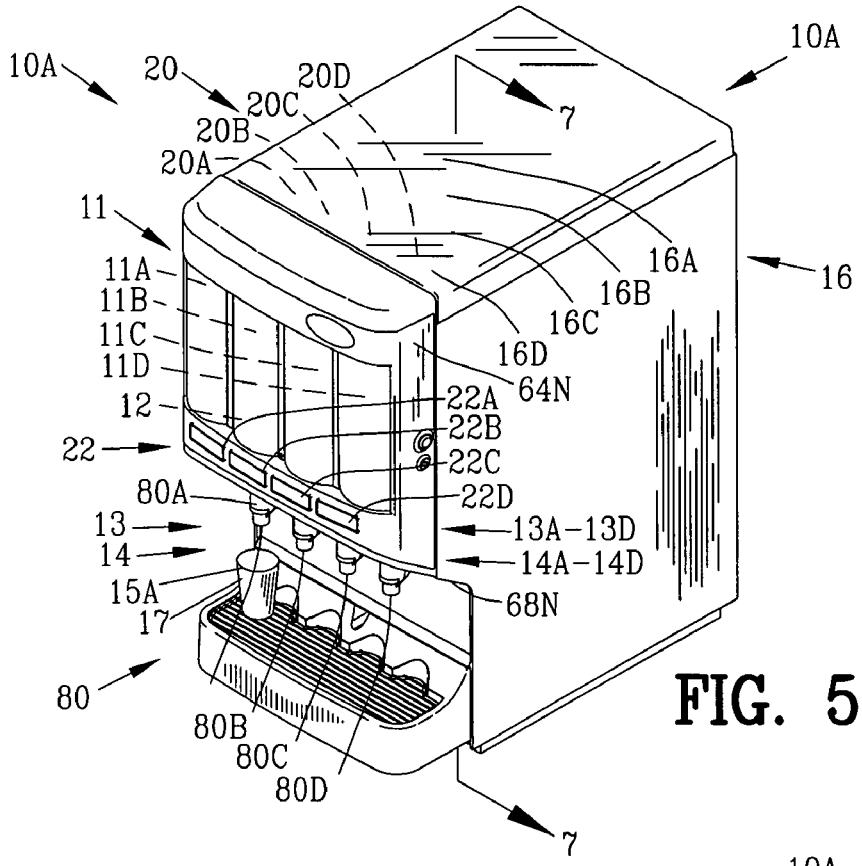
FIG. 5 is an isometric view of a dispenser system similar to the prior art dispenser in FIG. 1 incorporating the terminal orifice processor of the present invention.

FIG. 5 is an isometric view of the terminal orifice processor 80 of the present invention incorporated into the dispenser device 10A similar to the prior art dispenser device 10 shown in FIGS. 1-4. In this example, the dispenser device 10A is provided with a new or upgraded front door 64N from the dispenser device 10 shown in FIG. 1. A connector 90 secures the terminal orifice processor 80 below the discharging aperture 14 of the pump and mixing device 20. In this embodiment of the invention, a front door bottom 68N of the front door 64N provides a support for the connector 90 of the terminal orifice processor 80.

In this example, four separate terminal orifice processors 80A-80D are located below the discharging apertures 14A-14D of the pump and mixing devices 20A-20D, respectively. Although four separate terminal orifice processors 80A-80D have been shown located below the discharging apertures 14A-14D of the pump and mixing devices 20A-20D, it should be understood that the present invention is incorporated into a single terminal orifice processor 80.

Figure 6:
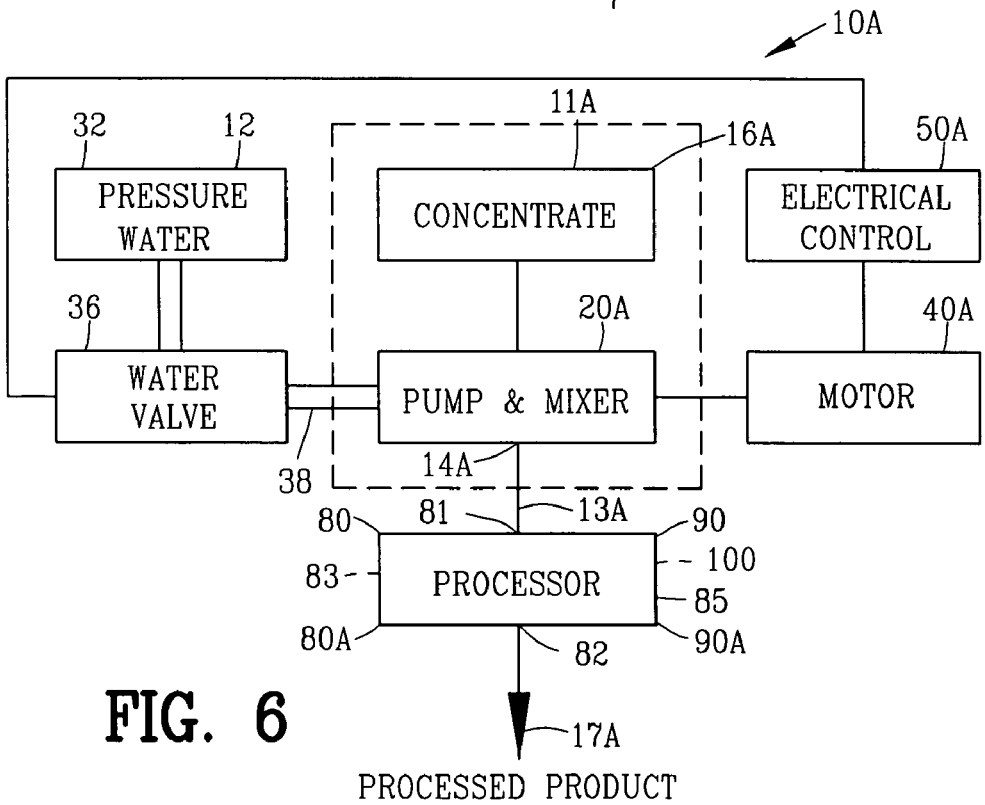
FIG. 6 is a block diagram of the dispenser system of FIG. 5.

FIG. 6 is a block diagram similar to FIG. 2 illustrating the improved terminal orifice processor 80A with the pump and mixing device 20A of the prior art dispenser device 10. The terminal orifice processor 80 includes an input orifice 81 and a terminal orifice 82 interconnected by a processing channel 83. The input orifice 81, terminal orifice 82 and processing channel 83 are defined within a housing 85. An optional insert 100 may be located within the processing channel 83.

The pump and mixing device 20A operates in the same manner as set forth with reference to FIG. 2. Upon actuation of the switch 22A, the second liquid diluent 12 flows through the water valve 36 and the conduit 38 into the pump and mixing device 20A. The pump and mixing device 20A pumps the first liquid concentrate 11A from the concentrate container 16A. The movement of the pump and mixing device 20A by the motor 40A pumps and mixes the first liquid concentrate 11A with the second liquid diluent 12 and discharge the mixed product 13A from the discharge aperture orifice 14A.

The mixed product 13A moves by action of gravity into the input orifice 81 of the terminal orifice processor 80. The flow of the mixed product 13A through the processing channel 83 enhances the characteristic of the mixed product 13A into a processed product 17A. The processed product 17A is discharged from the terminal orifice 82 of the terminal orifice processor 80 into the cup 15 with enhanced discharge characteristics.

Figure 7:
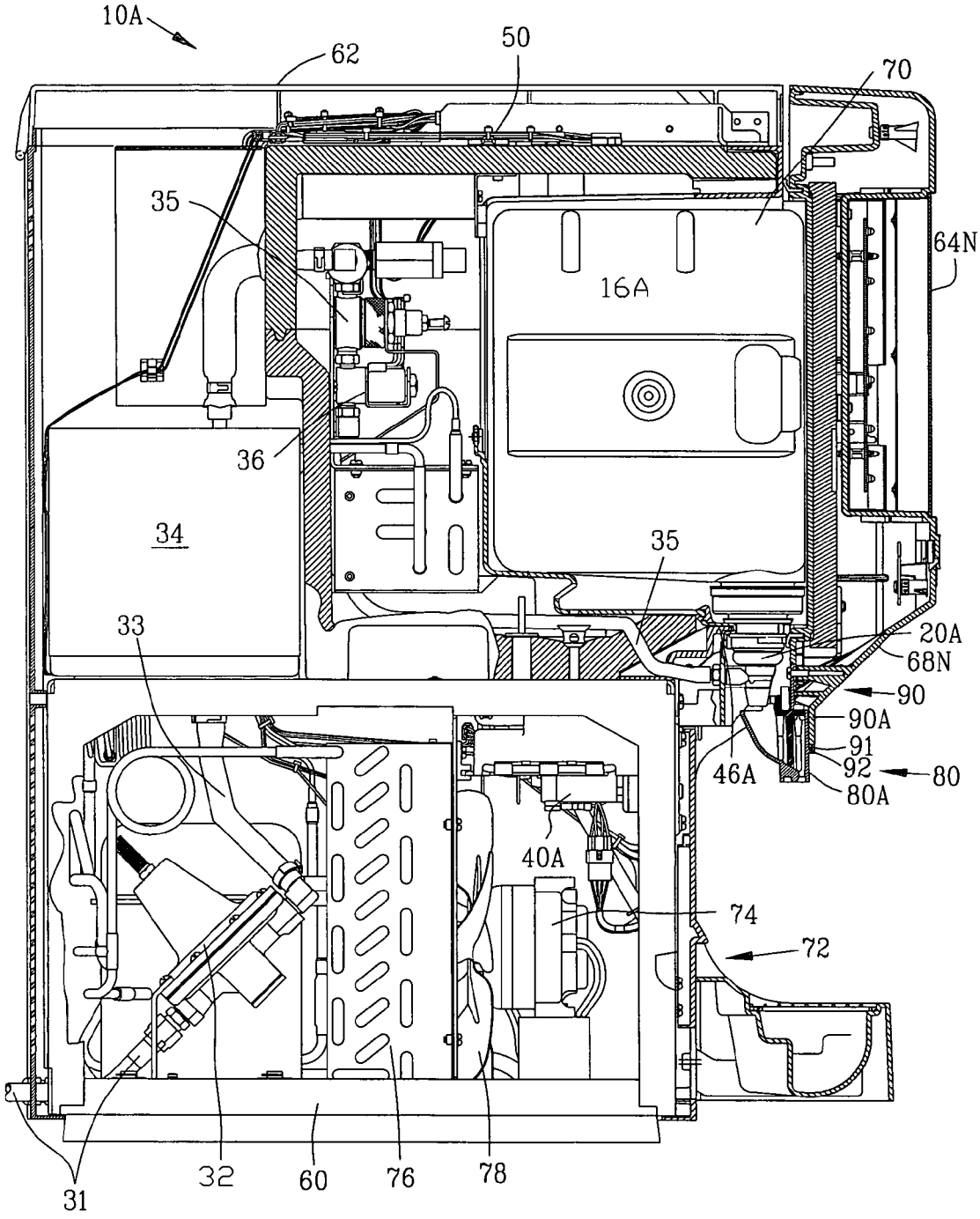
FIG. 7 is a sectional view along line 7-7 in FIG. 5.
Figure 8:
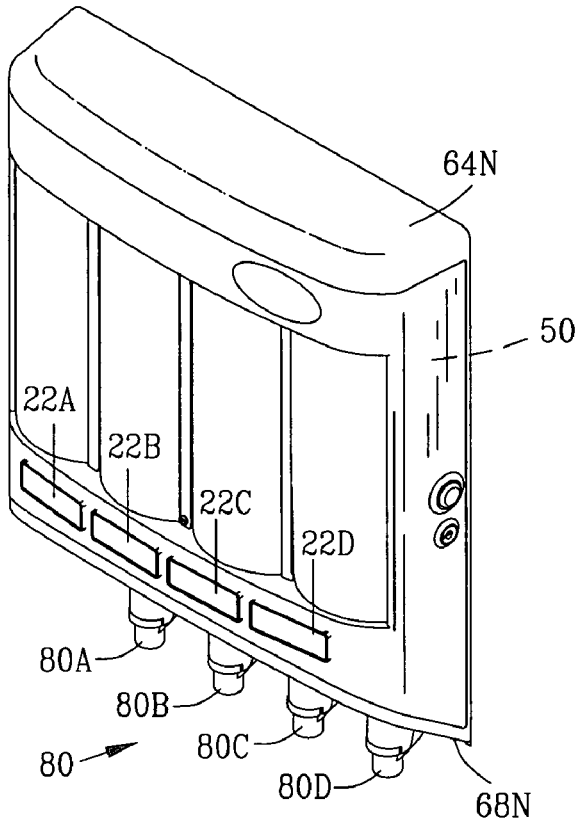
FIG. 8 is an enlarged isometric view of the front door of the dispenser system of FIG. 5.
Figure 9:
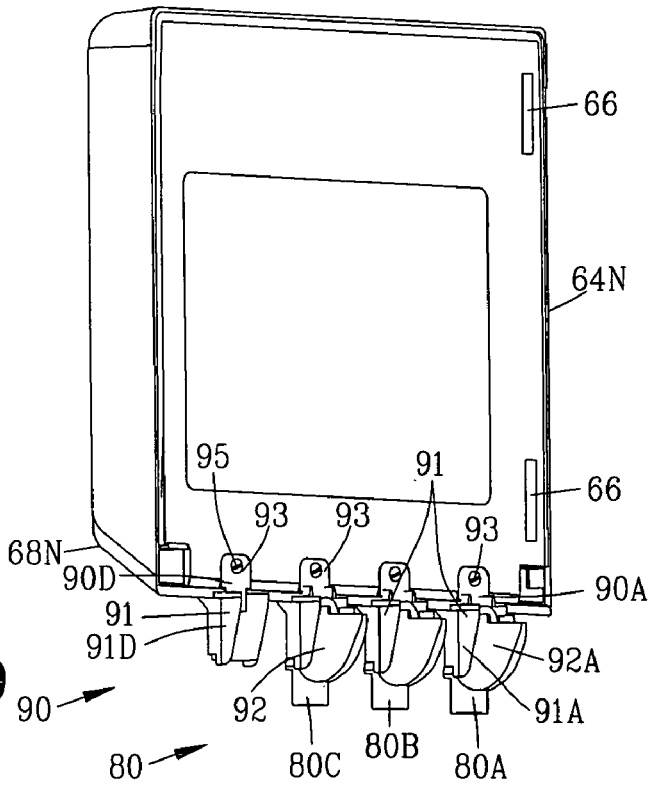
FIG. 9 is a rear isometric view of the front door of FIG. 8.
Figure 10:
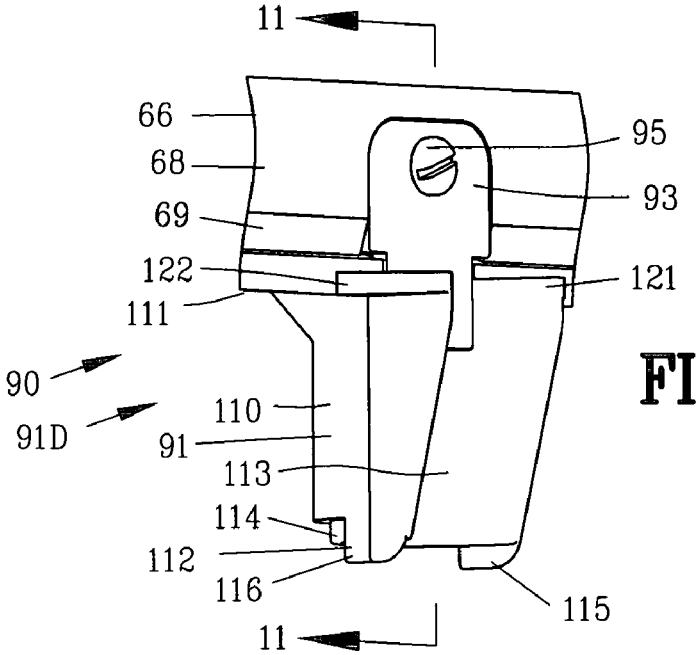
FIG. 10 is an enlarged view of a first portion of FIG. 9 illustrating a connector.
Figure 12:
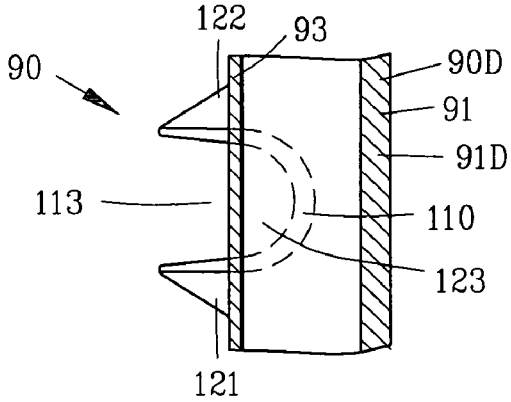
FIG. 12 is a sectional view along line 12-12 in FIG. 11.
Figure 11:
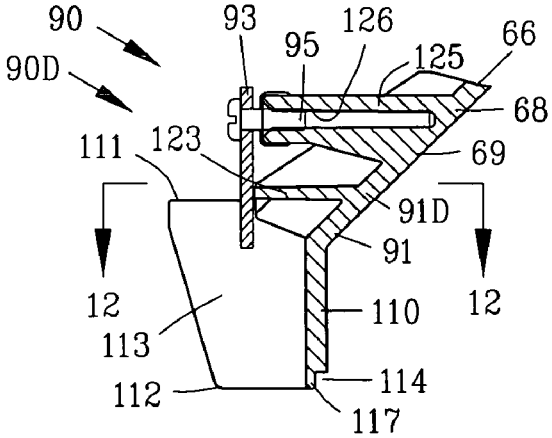
FIG. 11 is a sectional view along line 11-11 in FIG. 10.

FIGS. 7-9 are various views of the connectors 90 for securing the terminal orifice processor 80 relative to the pump and mixing devices 20. In this example, the connectors 90 secure the terminal orifice processors 80A-80D to the front door bottom 68N of the front door 64N. The terminal orifice processors 80A-80D are located below the discharge apertures 14A-14D of the pump and mixing devices 20A-20D with the front door 64N is in the closed position.

In this specific example, the front door 64N is an upgrade replacement for the prior art dispensing device 10 shown in FIG. 1. The upgrade replacement front door 64N is provided with the support coupling 91 integrally formed in the front door bottom 68N of the upgrade replacement front door 64N. It should be appreciated by those skilled in the art that the connectors 90 may be mechanically attached to the front door 64N or other portions of the dispenser device 10A to located the terminal orifice processors 80A-80D below the pump and mixing devices 20A-20D.

FIGS. 10-13 are various views of a portion of FIG. 9 illustrating the support coupling 91 for supporting the housing 85 relative to the pump and mixing device 20A-20D. The support coupling 91 comprises a partial cylindrical support 110 extends between a proximal end 111 and a distal end 112. The partial cylindrical support 110 defines a partial cylindrical receiver 113 for receiving the housing 85. The proximal end 111 is integrally formed with the front door bottom 68N of the front door 64N.

The distal end 112 of the partial cylindrical support 110 includes a central recess 114 defining side stops 115 and 116 on opposed sides of the central recess 113. The central recess 114 provides a region of reduced thickness of the partial cylindrical support 110 defining a key 117.

The support coupling 91 includes the side flanges 121 and 122 located on opposed sides of the partial cylindrical support 110. A central wall 123 extends partially into the partial cylindrical receiver 113. A boss 125 having a threaded aperture 126 extends from the front door 64N.

The connector plate 93 is affixed to the front door 64N by a screw 95 threading into the threaded aperture 126 of the boss 125. The connector plate 93 engages with the central wall 123.

Figure 13:
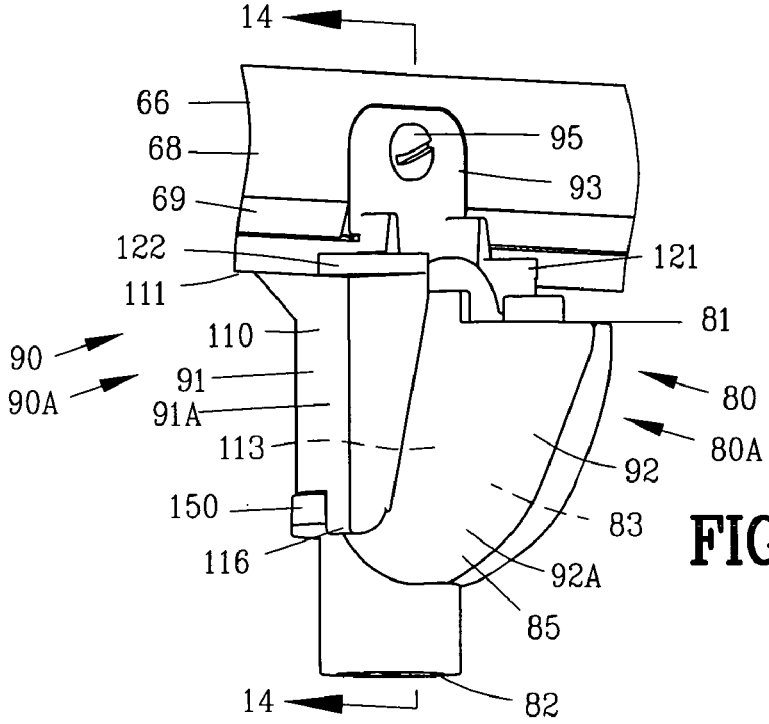
FIG. 13 is an enlarged view of a second portion of FIG. 9 illustrating the connector receiving a housing.
Figure 15:
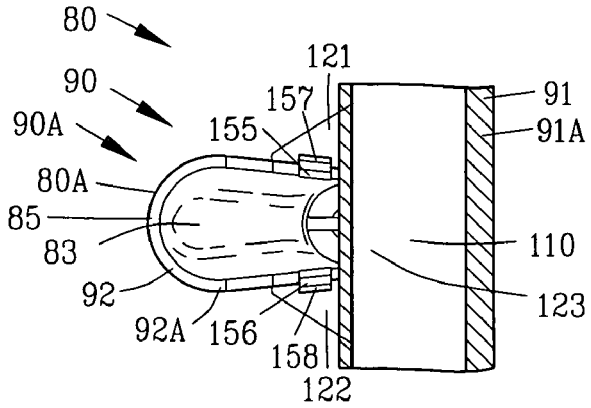
FIG. 15 is a sectional view along line 15-15 in FIG. 14.
Figure 14:
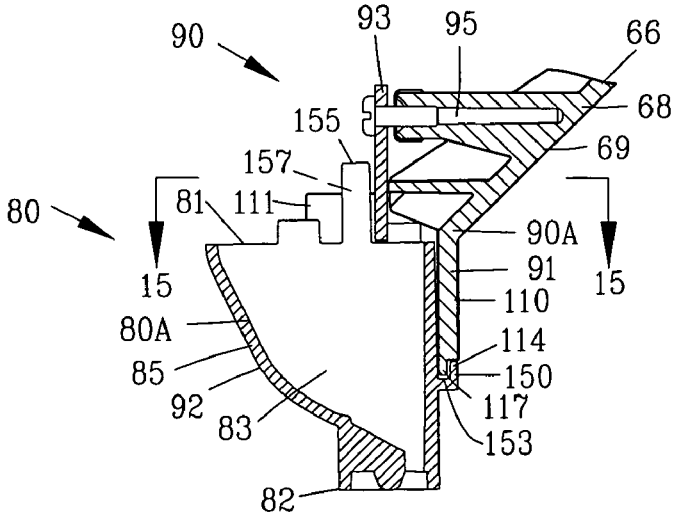
FIG. 14 is a sectional view along line 14-14 in FIG. 13.
Figure 17:
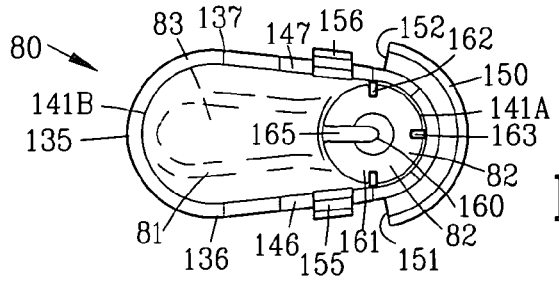
FIG. 17 is a top view of FIG. 16.
Figure 16:
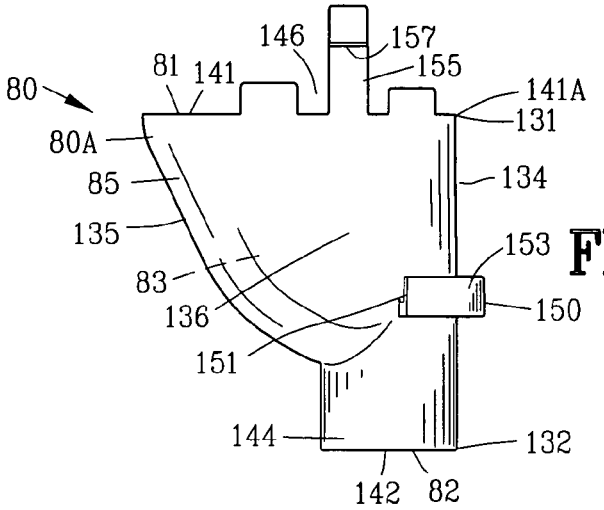
FIG. 16 is a magnified side view of the housing of the terminal orifice processor of FIG. 14.
Figure 18:
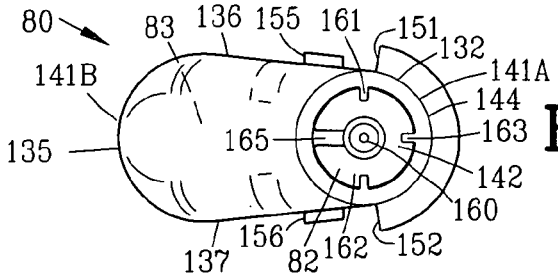
FIG. 18 is a bottom view of FIG. 16.
Figure 19:
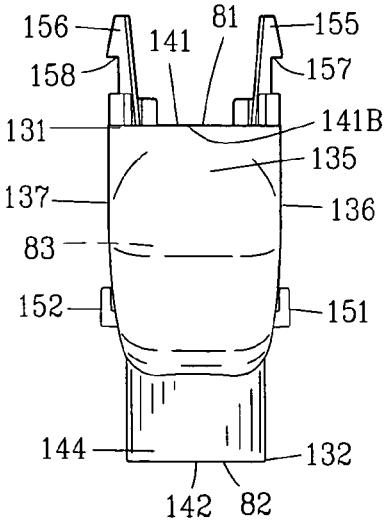
FIG. 19 is a rear view of FIG. 16.
Figure 20:
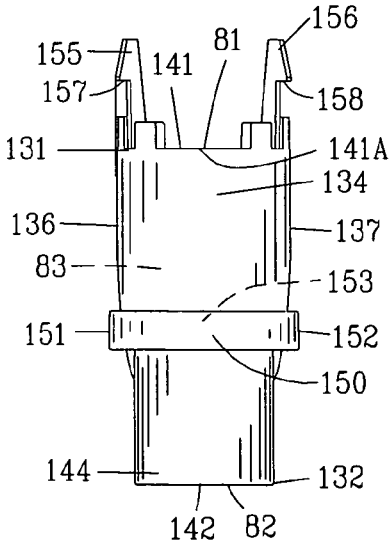
FIG. 20 is a front view of FIG. 16.

FIGS. 13-15 are various views of a portion of FIG. 9 illustrating the housing 85 secured to the front door 64N by the support coupling 91 and the housing coupling 92. As will be described in greater detail hereinafter, the housing coupling 92 connects to the support coupling 91 in a snap locking engagement.

FIGS. 16-20 are various views of the housing 85 of the terminal orifice processor 80. The housing 85 extends between a proximal end 131 and a distal end 132. The housing 85 comprises a first and a second sidewall 134 and 135, a front wall 136, a rear wall 137. The rear wall 137 is angled relative to the front wall 136 of the housing 85. Preferably, the housing 85 is formed from a generally rigid polymeric material as a one-piece unit.

The housing 85 defines a housing input 141 and a housing output 142 located at the proximal and distal ends 131 and 132 of the housing 85. The housing input 141 is elongated having generally circular ends 141A and 141B. The housing output 142 is a generally circular forming a substantially cylindrical nozzle 144. The elongated housing input 141 is larger than the generally circular housing output 142 enabling the input orifice 81 to be offset from the terminal orifice 82.

The housing coupling 92 comprises an arcuate overhang 150 extending between overhang ends 151 and 152. A receiver groove 153 is located within the arcuate overhang 150. The receiver groove 153 is adapted to receive the key 117 located at the distal end 112 of the partial cylindrical support 110.

The housing coupling 92 further comprises resilient tabs 155 and 156 extending from the proximal end 131 of the housing 85. The resilient tabs 155 and 156 include lugs 157 and 158 for engaging with the side flanges 121 and 122 located on opposed sides of the partial cylindrical support 110.

In this example, the cylindrical nozzle 144 of the housing output 142 includes a central obstruction 160. A first, second and third ribs 161-163 are located about the peripheral of the circular housing output 142. A support 165 positions the central obstruction 160 within the center of the circular housing output 142.

Referring back to FIGS. 13-15, the housing 85 is secured to the front door 64N in the following manner. The housing 85 is positioned at an angle relative to partial cylindrical support 110. The housing 85 is positioned with the distal end 132 of the housing 85 being closer to the distal end 112 of the partial cylindrical support 110 than the proximal end 131 of the housing 85 is from the distal end 111 of the partial cylindrical support 110. The housing 85 is move upwardly such that the key 117 of the support coupling 91 is inserted within the groove 153 of the arcuate overhange 150. The side stops 115 and 116 of the support coupling 91 engage with the overhang ends 151 and 152 prevent axial movement of the housing 85 relative to the front door 64N.

As the key 117 is inserted within the groove 153, the proximal end 131 of the housing 85 is rotated about the key 117. As the housing 85 is rotated about the key 117, the partially cylindrical receiver 113 compresses resilient tabs 155 and 156 inwardly within the partial cylindrical receiver 113. When the housing 85 is rotated about the key 117 into parallel orientation relative to the partially cylindrical receiver 113, the resilient tabs 155 and 156 expand outwardly enabling the lugs 157 and 158 to engage with the side flanges 121 and 122 of the support coupling 91 to secure the housing 85 to the front door 64N.

The housing 85 is removed from the front door 64N in the following manner. The resilient tabs 155 and 156 are compressed by an operator for disengaging the lugs 157 and 158 from the side flanges 121 and 122 of the support coupling 91. The housing 85 is rotated about the key 117 to remove the resilient tabs 155 and 156 from the partially cylindrical receiver 113. Thereafter, the housing 85 is moved downwardly to remove the key 117 of the support coupling 91 from the groove 153 of the arcuate overhang 150. The housing 85 may be totally removed from the front door 64N.

Figure 21:
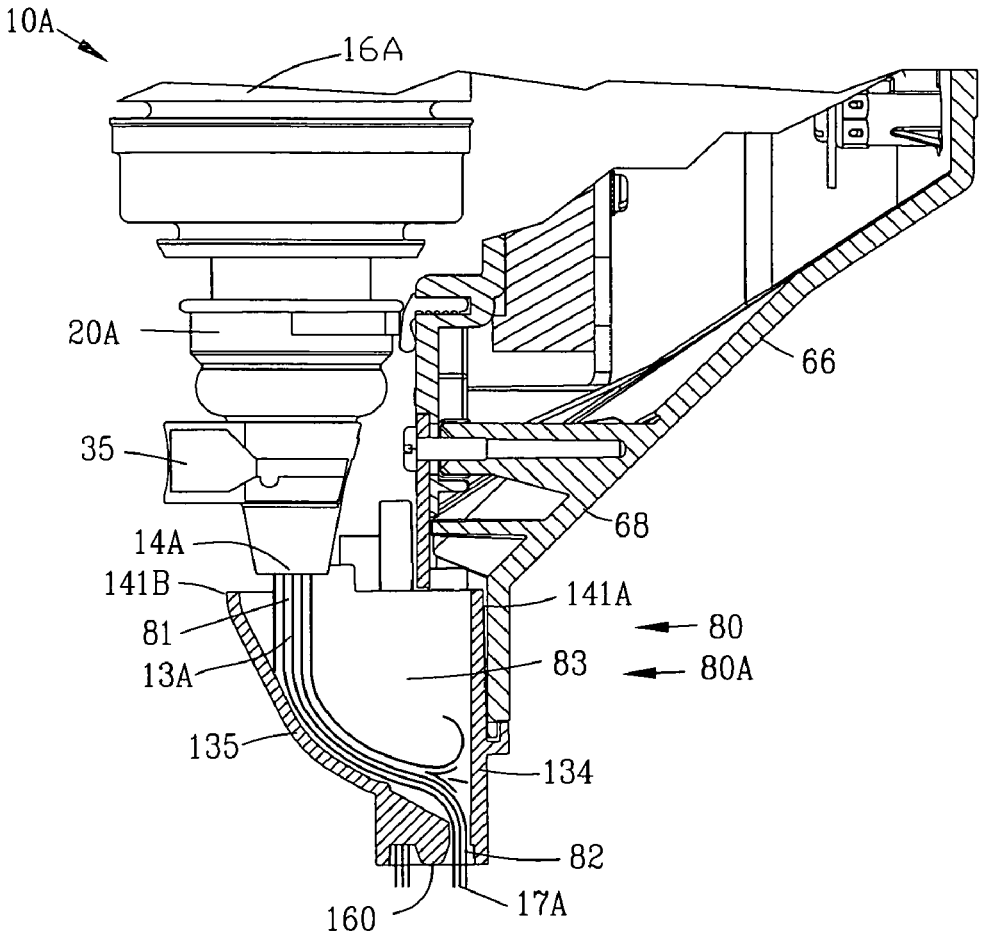
FIG. 21 is an enlarged view of a portion of FIG. 7 illustrating the operation of the terminal orifice processor of FIGS. 7-20.

FIG. 21 is an enlarged view of a portion of FIG. 7 illustrating the operation of the terminal orifice processor 60 of FIGS. 7-20. The housing 85 is secured to the front door 64N with the housing input 141 of the housing 85 below the discharging aperture 14A.

Upon actuation of the switch 22A, the second liquid diluent 12 flows into the pump and mixing device 20A. The pump and mixing device 20A pumps the first liquid concentrate 11A from the concentrate container 16A. The movement of the pump and mixing device 20A by the motor 40A pumps and mixes the first liquid concentrate 11A with the second liquid diluent 12 and discharge the mixed product 13A from the discharge aperture orifice 14A.

The mixed product 13A moves by action of gravity into the input orifice 81 of the terminal orifice processor 80. The mixed product 13A enters the processing channel 83 between the input orifice 81 and the terminal orifice 82. The processing channel 83 processes the mixed product 13A prior to exiting from the terminal orifice 82 as the processed product 17A.

The mixed product 13A emanating from the discharging aperture 14A impacts the angled rear wall portion of the rear wall 135 for altering the direction of the mixed product 13A. The mixed product 13A flows along the angled rear wall 135 to impact the front wall 134. The impact of the mixed product 13A with the angled rear wall 135 and the front wall 134 substantially reduces the velocity of the mixed product 13A. Furthermore, the impact of the mixed product 13A with the angled rear wall 135 and the front wall 134 results in substantial turbulence of the mixed product 13A. The impact and the turbulence imparted to the mixed product 13A results in the additional mixing and aeration of the mixed product 13A to provide the processed product 17A. The processed product 17A exits from the terminal orifice 82.

The obstruction 160 is located in the housing output 142 of the housing 85 for forming the terminal orifice 82. The obstruction 160 provides additional mixing and aeration of the mixed product 13A to provide the processed product 17.

The flow of the mixed product 13A through the processing channel 83 and about the obstruction 160 enhances the characteristic of the mixed product 13A into a processed product 17A. The processed product 17A is discharged from the terminal orifice 82 of the terminal orifice processor 80 into the cup 15 with enhanced discharge characteristics.

Firstly, the flow of the mixed product 13A through the processing channel 83 and about the obstruction 160 provides additional mixing for the mixed product 13A. Secondly, the flow of the mixed product 13A through the processing channel 83 and about the obstruction 160 provides aeration for the mixed product 13A. Thirdly, the reduced velocity of the mixed product 13A due to the impact of the mixed product 13A with the angled rear wall 135 and the front wall 134 allows the dispensing device 10A to operate at a higher pumping rate of the pump and mixing device 20A.

Figure 22:
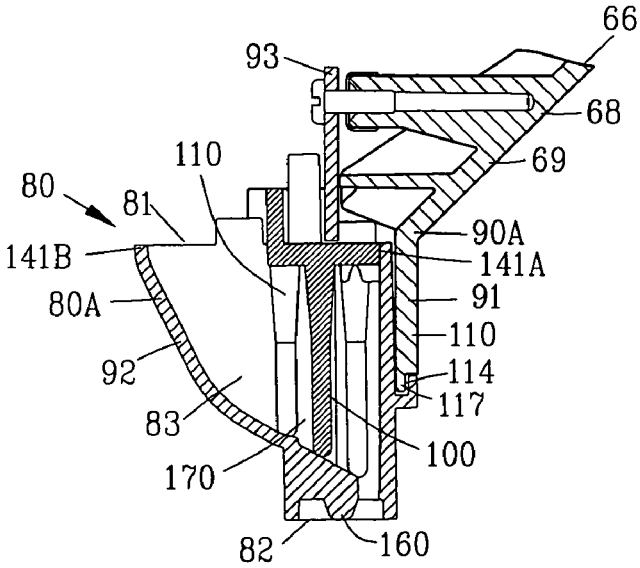
FIG. 22 is a view similar to FIG. 14 illustrating a second embodiment of the invention.
Figure 24:
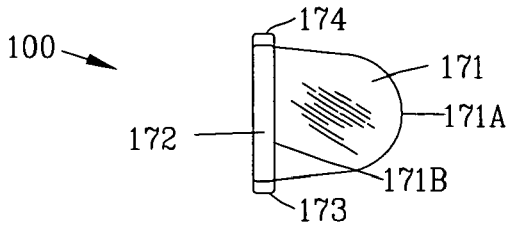
FIG. 24 is a top view of FIG. 23.

FIG. 22 is a view similar to FIG. 14 illustrating a second embodiment of the invention. In this embodiment of the invention, a housing insert 100 is incorporated into the housing 85 shown in FIGS. 13-21. A housing insert 100 creates a tortuous path 170 within the processing channel 83 between the input orifice 81 and the terminal orifice 82.

Figure 23:
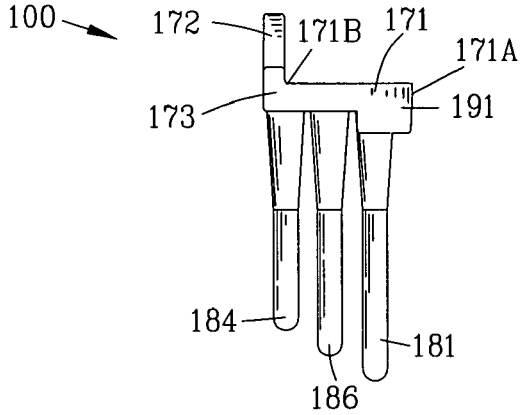
FIG. 23 is a side view of a housing insert of the terminal orifice processor of the present invention.
Figure 25:
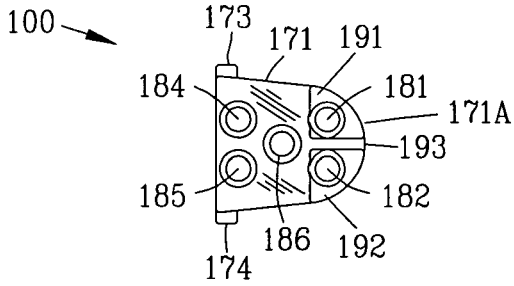
FIG. 25 is a bottom view of FIG. 23.
Figure 26:
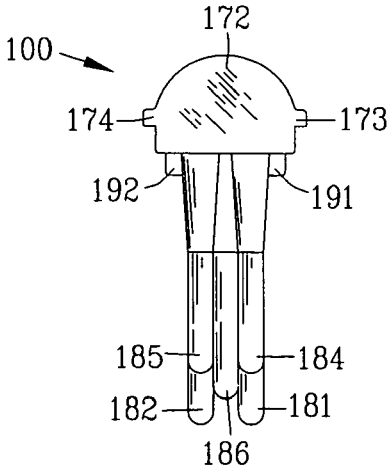
FIG. 26 is a rear view of FIG. 23.
Figure 27:
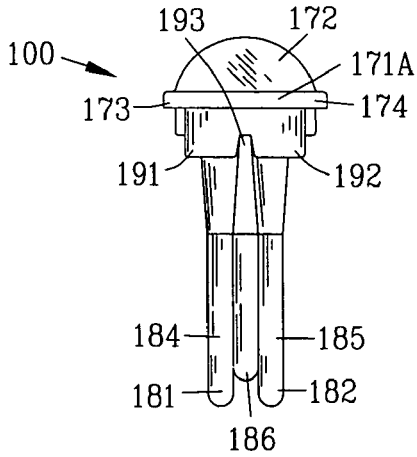
FIG. 27 is a front view of FIG. 23.
Figure 29:
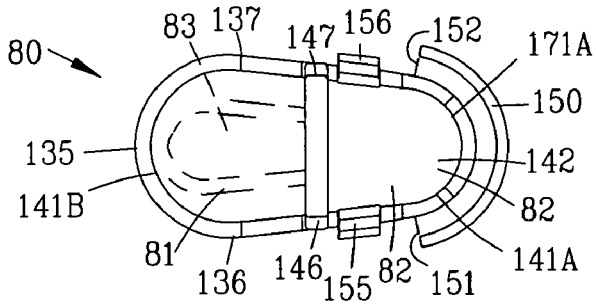
FIG. 29 is a top view of FIG. 28.
Figure 28:
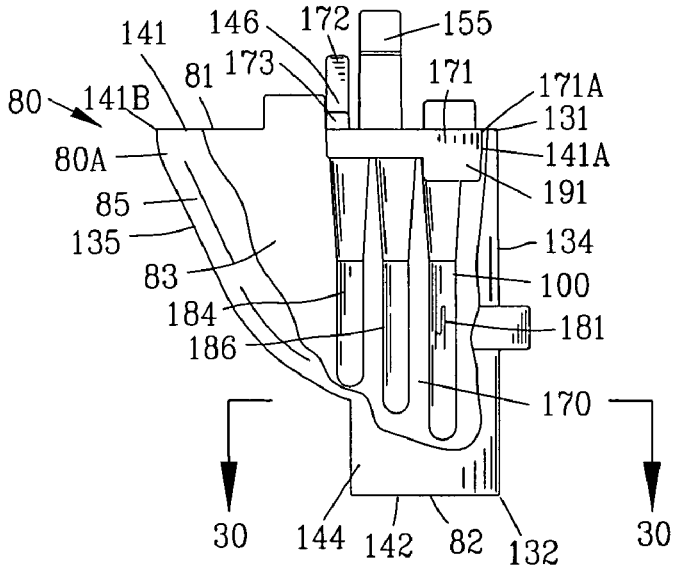
FIG. 28 is a partially cut out side view of the housing of FIG. 16 with the housing insert of FIGS. 23-27.

FIGS. 23-27 are various views of the insert 100 of FIG. 23. The housing insert 100 comprises a transverse wall 171. The transverse wall 171 includes a partially circular end 171A for mating with the generally circular end 141A of the housing input 141 of the housing 85. An end 171B of the transverse wall 171 supports a vertical wall 172. The transverse wall 171 includes outwardly extending plural ribs 173 and 174 located adjacent to the vertical wall 172.

The housing insert 110 comprises a plurality of depending fingers 181-186 extending from an underside of the transverse 171. The plurality of depending fingers 181-186 include front fingers 181 and 182, rear fingers 184 and 185 and a central finger 186. The front fingers 181 and 182 are longer than the central finger 186. Similarly, the central finger 186 is longer than the rear fingers 184 and 185.

The housing insert 110 includes a first and a second foundation 191 and 192 formed on the underside of the transverse 171. A groove 193 is defined between the first and second foundations 191 and 192. Preferably, the housing insert 110 including the plurality of depending fingers 181-186 are formed from a one piece, generally flexible polymeric material.

FIGS. 28-31 are various views of the housing 85 including the housing insert 100 shown in FIG. 22. The housing insert 100 is inserted within the housing 85 with the partially circular end 171A of the transverse 171 mating with the generally circular end 141A of the housing input 141 of the housing 85. The outwardly extending plural ribs 173 and 174 are received within the slots 146 and 147. The ribs 161-163 of the housing 85 cooperate with the first and second foundations 191 and 192. The rib 163 is received with the groove 193 defined between the first and second foundations 191 and 192. The ribs 161 and 162 are located on the opposite sides of the first and second foundations 191 and 192 from the groove 193. The plural ribs 173 and 174 and the first and second foundations 191 and 192 of the housing insert 100 cooperates with the slots 146 and 147 and the ribs 161-163 of the housing 85 to secure the housing insert 100 within the housing 85.

The transverse wall 171 is offset axially from a center of the cylindrical nozzle 144 of the housing output 141. The transverse wall 171 defines the input orifice 81 that is offset axially from the terminal orifice 82.

Figure 30:
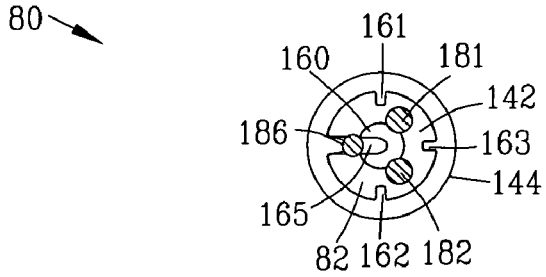
FIG. 30 is a sectional view along line 30-30 in FIG. 28.
Figure 31:
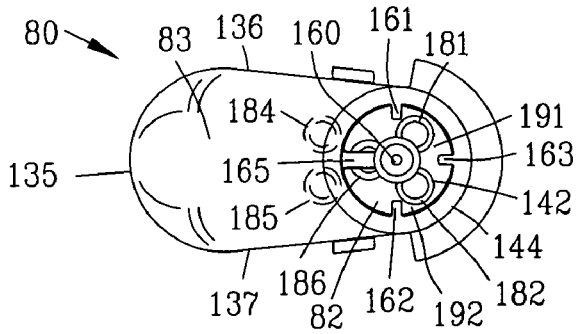
FIG. 31 is a bottom view of FIG. 28.

As best shown in FIGS. 30 and 31, the front fingers 181 and 182 and the central finger 186 are positioned about the central obstruction 160. The rear fingers 184 and 185 are positioned adjacent to the rear wall 135 and are offset from the cylindrical nozzle 144. The obstruction 160 located centrally in the housing output 142 of the housing 85 cooperates with the plurality of depending fingers 181-186 for creating the tortuous path 170 between the input orifice 81 and the terminal orifice 82.

Figure 32:
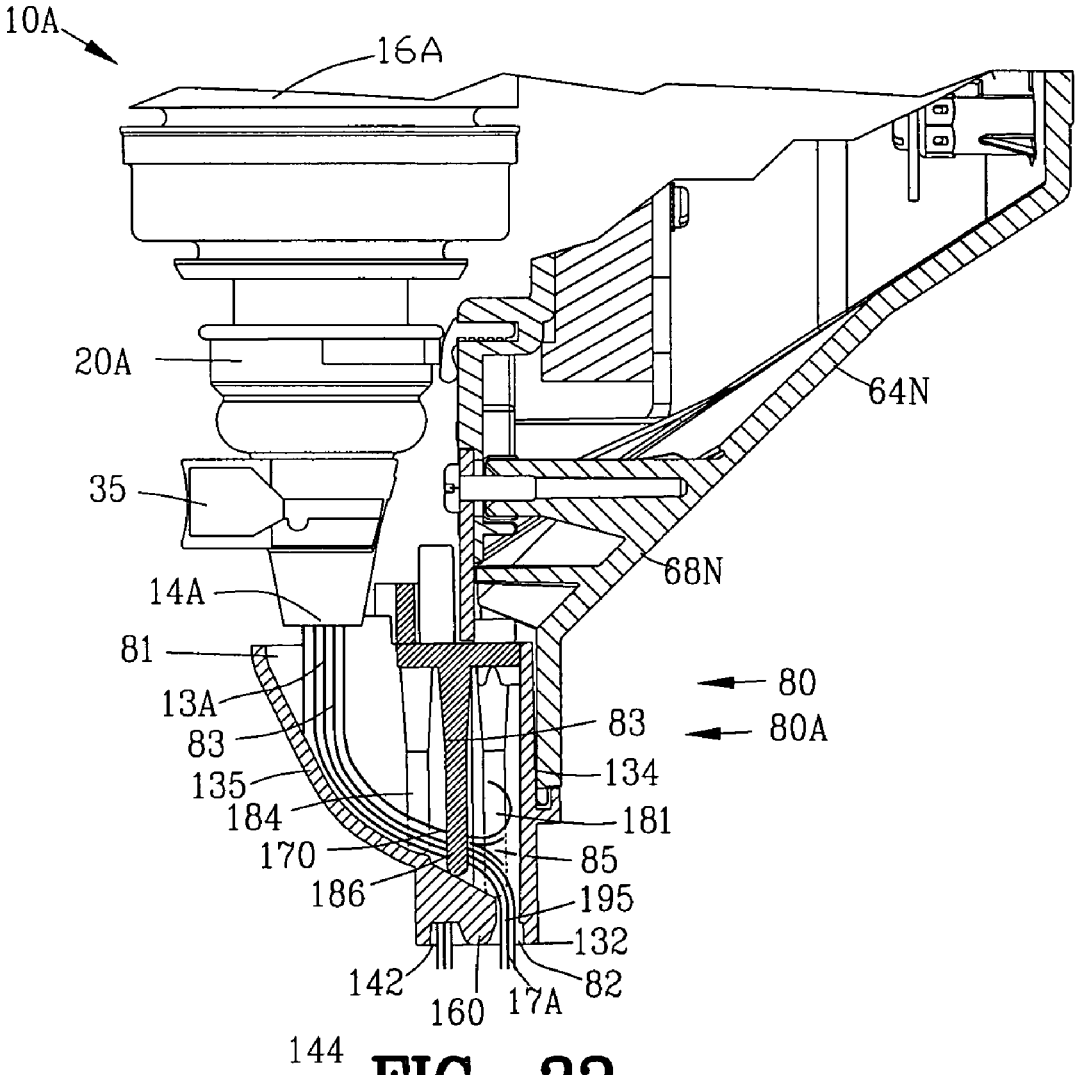
FIG. 32 is an enlarged view illustrating the operation of the terminal orifice processor of FIGS. 22-30.
Figure 33:
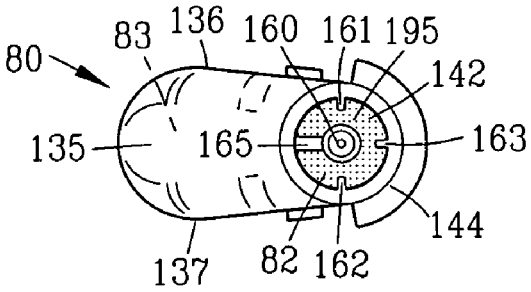
FIG. 33 is a bottom view of a portion of FIG. 32.

FIGS. 32 and 33 are enlarged views illustrating the operation of the terminal orifice processor 80 of FIGS. 22-30. The housing 85 is secured to the front door 64N with the input orifice 81 of the housing 85 below the discharging aperture 14A.

Upon actuation of the switch 22A, the second liquid diluent 12 flows into the pump and mixing device 20A. The pump and mixing device 20A pumps the first liquid concentrate 11A from the concentrate container 16A. The movement of the pump and mixing device 20A by the motor 40A pumps and mixes the first liquid concentrate 11A with the second liquid diluent 12 and discharge the mixed product 13A from the discharge aperture orifice 14A.

The mixed product 13A moves by action of gravity into the input orifice 81 of the terminal orifice processor 80. The mixed product 13A enters the processing channel 83 between the input orifice 81 and the terminal orifice 82. The processing channel 83 processes the mixed product 13A prior to exiting from the terminal orifice 82 as the processed product 17A.

The mixed product 13A emanating from the discharging aperture 14A impacts the angled rear wall portion of the rear wall 135 for altering the direction of the mixed product 13A. The mixed product 13A flows through the tortuous path 170 defined by the plurality of depending fingers 181-186 to pass through the tortuous path 170. The tortuous path 170 defined by the plurality of depending fingers 181-186 results in substantial turbulence of the mixed product 13A. The turbulence imparted to the mixed product 13A results in the additional mixing and aeration of the mixed product 13A to provide the processed product 17A.

After the mixed product 13A passes through the tortuous path 170 defined by the plurality of depending fingers 181-186, the mixed product 13A impacts the front wall 134. The mixed product 13A reflects off of the front wall 134 to reenter the tortuous path 170 between the plurality of depending fingers 181-186 and/or a second tortuous path 195 defined between the front fingers 181 and 182, the central finger 186 and the central obstruction 160.

The impact of the mixed product 13A with the angled rear wall 135, the tortuous path 170 between the plurality of depending fingers 181-186, the front wall 134 and the second tortuous path 195 substantially reduces the velocity of the mixed product 13A and results in substantial turbulence, mixing and aeration of the mixed product 13A to provide the processed product 17A. The processed product 17A exits from the terminal orifice 82.

The obstruction 160 and the cooperating front fingers 181 and 182 and central finger 186 forms the terminal orifice 82. The obstruction 160 and the cooperating front fingers 181 and 182 and central finger 186 provide additional mixing and aeration of the mixed product 13A to provide the processed product 17A.

The flow of the mixed product 13A through the processing channel 83 and about the obstruction 160 enhances the characteristic of the mixed product 13A into a processed product 17A. The processed product 17A is discharged from the terminal orifice 82 of the terminal orifice processor 80 into the cup 15 with enhanced discharge characteristics.

The housing insert 110 including the plurality of depending fingers 181-186 are formed from a generally flexible polymeric material. The flexibility of the plurality of depending fingers 181-186 reduces the possibility of buildup of semi-solid matter contained in the mixed product 13A. For example, if the first liquid concentrate 11 is a juice product, the juice product may contain a semi-solid pulp matter.

The flow of the mixed product 13A impacting the plurality of depending fingers 181-186 causes the plurality of depending fingers 181-186 to move or to vibrate. The flexible movement of the flexible depending fingers 181-186 reduces the buildup of the semi-solid pulp matter. In addition, the housing insert 110 may be readily removed from the housing 85 for cleaning and the like.

The terminal orifice processor of the present invention provides a system which substantially advances the liquid dispensing art. Firstly, the flow of the mixed product 13A through the processing channel 83 and about the obstruction 160 provides additional mixing for the mixed product 13A. Secondly, the flow of the mixed product 13A through the processing channel 83 and about the obstruction 160 provides aeration for the mixed product 13A. Thirdly, the reduced velocity of the mixed product 13A due to the impact of the mixed product 13A with the angled rear wall 135 and the front wall 134 allows the dispensing device 10A to operate at a higher pumping rate of the pump and mixing device 20A.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A terminal orifice processor for processing a first and a second liquid emanating from a discharging aperture, comprising:

a housing having a front wall, a rear wall and a first and a second sidewall interconnecting a housing input and a housing output;

said rear wall including an angled rear wall portion forming an angle relative to said front wall axially offsetting said housing output relative to said housing input;

a connector for locating said housing input of said housing below the discharging aperture for enabling the first and second liquid emanating from the discharging aperture to impact said angled rear wall portion of said rear wall;

a housing insert located between said housing input and said housing output creating a tortuous path between said housing input and said housing output for processing the first and second liquid prior to exiting from said housing output;

said housing insert comprises a generally transverse wall defining an upper chamber and a lower chamber with a transverse wall aperture communicating said upper chamber with said lower chamber;

said transverse wall aperture being offset axially from said housing output; and a plurality of generally parallel depending fingers integrally formed with said transverse wall extending generally perpendicular to said transverse wall to be in proximity to said housing output.

2. A terminal orifice processor as set forth in claim 1, wherein said housing input and said housing output are integral with said housing as a one piece unit.

3. A terminal orifice processor as set forth in claim 1, wherein said housing input comprises a housing input orifice and said housing output comprising a housing output orifice; and said housing input orifice being larger than said output orifice.

4. A terminal orifice processor as set forth in claim 1, wherein said housing input comprises a housing input orifice and said housing output comprising a housing output orifice; and said housing input orifice being an elongated orifice; and said housing output orifice comprising a substantially cylindrical nozzle defining said housing output orifice.

5. A terminal orifice processor as set forth in claim 1, wherein said housing insert is formed from a generally flexible polymeric material.

6. A dispenser system comprising;

a cabinet having a hinged front door;

dispenser device having a discharge aperture for dispensing a mixed first and second liquid from a discharge aperture;

a mounting for securing said dispenser device within the cabinet;

a terminal orifice processor having an input orifice and a terminal orifice;

a connector for connecting said terminal orifice processor to the hinged front door for locating said input orifice below said discharge aperture of said dispenser device when the hinged front door is in a closed position; and a processing channel interposed between said input orifice and said terminal orifice for altering the direction of the mixed first and second liquids emanating from the discharging aperture for processing the first and second liquids prior to exiting from said terminal orifice.

7. A dispenser device as set forth in claim 6, including an insert having a plurality of generally parallel depending fingers extending in proximity to said terminal orifice; and an obstruction located adjacent to said terminal orifice and cooperating with said plurality of generally parallel depending fingers for creating said tortuous path between said input orifice and a terminal orifice.

* * * * *